US008517112B2

(12) United States Patent
Niemeyer et al.

(10) Patent No.: US 8,517,112 B2
(45) Date of Patent: Aug. 27, 2013

(54) SYSTEM AND METHOD FOR SUBSEA CONTROL AND MONITORING

(75) Inventors: Matthew W. Niemeyer, Alvin, TX (US); Jeffrey J. Marabella, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 525 days.

(21) Appl. No.: 12/542,369

(22) Filed: Aug. 17, 2009

(65) Prior Publication Data

US 2010/0276155 A1 Nov. 4, 2010

Related U.S. Application Data

(60) Provisional application No. 61/174,005, filed on Apr. 30, 2009.

(51) Int. Cl.
*E21B 47/00* (2012.01)
*E21B 34/04* (2006.01)

(52) U.S. Cl.
USPC ..... 166/368; 166/352; 166/250.01; 166/373; 340/853.1

(58) Field of Classification Search
USPC ..... 166/366, 351, 352, 367, 368, 250.01, 166/373–375; 340/853.1, 853.3, 854.9
See application file for complete search history.

(56) References Cited

U.S. PATENT DOCUMENTS

| | | | | |
|---|---|---|---|---|
| 4,384,612 | A * | 5/1983 | Bradford et al. | 166/66 |
| 4,658,904 | A | 4/1987 | Doremus et al. | |
| 4,880,060 | A * | 11/1989 | Schwendemann et al. | 166/336 |
| 5,771,974 | A * | 6/1998 | Stewart et al. | 166/336 |
| 6,026,905 | A * | 2/2000 | Garcia-Soule | 166/336 |
| 6,125,938 | A * | 10/2000 | Garcia-Soule et al. | 166/344 |
| 6,293,344 | B1 * | 9/2001 | Nixon et al. | 166/363 |
| 6,457,521 | B1 | 10/2002 | Langseth et al. | |
| 6,564,872 | B2 * | 5/2003 | Davey et al. | 166/344 |
| 6,644,410 | B1 * | 11/2003 | Lindsey-Curran et al. | 166/360 |
| 6,691,785 | B2 | 2/2004 | Patel | |
| 6,725,924 | B2 * | 4/2004 | Davidson et al. | 166/250.01 |
| 6,877,557 | B2 * | 4/2005 | Richards et al. | 166/250.01 |
| 7,062,960 | B2 * | 6/2006 | Couren et al. | 73/152.51 |
| 7,261,162 | B2 * | 8/2007 | Deans et al. | 166/336 |
| 7,273,105 | B2 * | 9/2007 | Johansen et al. | 166/336 |
| 7,273,107 | B2 | 9/2007 | Hiron et al. | |
| 7,360,600 | B2 | 4/2008 | MacDougall | |

(Continued)

FOREIGN PATENT DOCUMENTS

| | | | |
|---|---|---|---|
| EP | 2039877 | A2 | 3/2009 |
| WO | 2010074713 | A1 | 1/2001 |
| WO | 2005098198 | A1 | 10/2005 |
| WO | 2009146206 | A1 | 12/2009 |

OTHER PUBLICATIONS

Scranton et al., International Search Report dated Jul. 7, 2010 from International Application No. PCT/US2010/032075 filed Apr. 22, 2010.

*Primary Examiner* — Matthew Buck

(74) *Attorney, Agent, or Firm* — Jeffery Peterson; Brandon S. Clark

(57) ABSTRACT

A technique operates a valve system in a subsea test tree via a control system of a type suitable for gaining desired industry ratings. A monitoring system is utilized to monitor functions of the control system, but the monitoring system is independent from the control system.

20 Claims, 4 Drawing Sheets

(56) References Cited

U.S. PATENT DOCUMENTS

| | | | | |
|---|---|---|---|---|
| 7,455,115 | B2 | 11/2008 | Loretz et al. | |
| 7,543,636 | B2 | 6/2009 | Malone et al. | |
| 7,578,350 | B2 * | 8/2009 | Cooper et al. | 166/368 |
| 7,628,207 | B2 * | 12/2009 | Leonardi et al. | 166/364 |
| 7,712,540 | B2 | 5/2010 | Loretz et al. | |
| 7,921,919 | B2 * | 4/2011 | Horton, III | 166/366 |
| 7,931,090 | B2 * | 4/2011 | Smedstad et al. | 166/366 |
| 7,967,066 | B2 * | 6/2011 | McStay et al. | 166/250.01 |
| 2004/0140125 | A1 | 7/2004 | Dezen et al. | |
| 2005/0100414 | A1 * | 5/2005 | Salama | 405/224.2 |
| 2005/0274528 | A1 | 12/2005 | Hiron et al. | |
| 2007/0169942 | A1 | 7/2007 | Loretz et al. | |
| 2007/0240882 | A1 * | 10/2007 | Leonardi et al. | 166/364 |
| 2007/0251696 | A1 | 11/2007 | Parks | |
| 2008/0105436 | A1 | 5/2008 | Molina et al. | |
| 2008/0217022 | A1 * | 9/2008 | Deans | 166/338 |
| 2008/0251260 | A1 | 10/2008 | Ross et al. | |
| 2008/0314590 | A1 | 12/2008 | Patel | |
| 2009/0020292 | A1 | 1/2009 | Loretz et al. | |
| 2009/0065212 | A1 | 3/2009 | Dcosta et al. | |
| 2009/0266555 | A1 | 10/2009 | May et al. | |
| 2009/0266556 | A1 | 10/2009 | Swenson et al. | |
| 2010/0038093 | A1 | 2/2010 | Patel | |
| 2010/0108326 | A1 | 5/2010 | Messick et al. | |
| 2011/0297387 | A1 * | 12/2011 | Hart | 166/345 |

* cited by examiner

SYSTEM AND METHOD FOR SUBSEA CONTROL AND MONITORING

CROSS-REFERENCE TO RELATED APPLICATION

The present application is based on and claims priority to U.S. Provisional Application Ser. No. 61/174,005, filed Apr. 30, 2009.

BACKGROUND

In a variety of subsea well related applications, subsea test trees (SSTTs) are installed within subsea risers during completion operations. The subsea test trees enable the safe and temporary closure of subsea wells. Depending on the application, a control system is positioned either at a topside location or a subsea location and coupled to the subsea test tree. The control system is used to actuate valves in the subsea test tree by controlling the delivery of hydraulic fluid through a control line. The hydraulic fluid is selectively applied to cause a desired change in state, e.g. transition of a valve, on the subsea test tree. In some of these applications, it may be desirable to design the control system with simplicity to obtain a desired Safety Integrity Level (SIL) rating recognized by the industry. However, designing the control system with simplicity for certification as an SIL unit can limit the ability to monitor functionality of the control system.

SUMMARY

In general, the present application provides a system and methodology for controlling a subsea test tree via a control system of a type suitable for gaining desired industry ratings. A monitoring system is utilized to monitor functions of the control system, but the monitoring system is independent from the control system.

BRIEF DESCRIPTION OF THE DRAWINGS

Certain embodiments will hereafter be described with reference to the accompanying drawings, wherein like reference numerals denote like elements, and.

DETAILED DESCRIPTION

In the following description, numerous details are set forth to provide an understanding of various embodiments. However, it will be understood by those of ordinary skill in the art that many embodiments may be practiced without these details and that numerous variations or modifications from the described embodiments may be possible.

The present application generally relates to a technique for utilizing subsea control devices in subsea applications. This technique also relates to instrumentation that involves sensors and/or monitoring in subsea control devices and applications. The subsea systems and methodologies can be employed in a variety of subsea applications with wells formed in many types of subsea environments. For example, wells may be formed as generally vertical wells or as deviated, e.g. horizontal, wells, and the equipment used in a given well application may be selected according to the type of well, subsea environment, surface equipment, and other factors that affect the specific well application.

Figure 1:
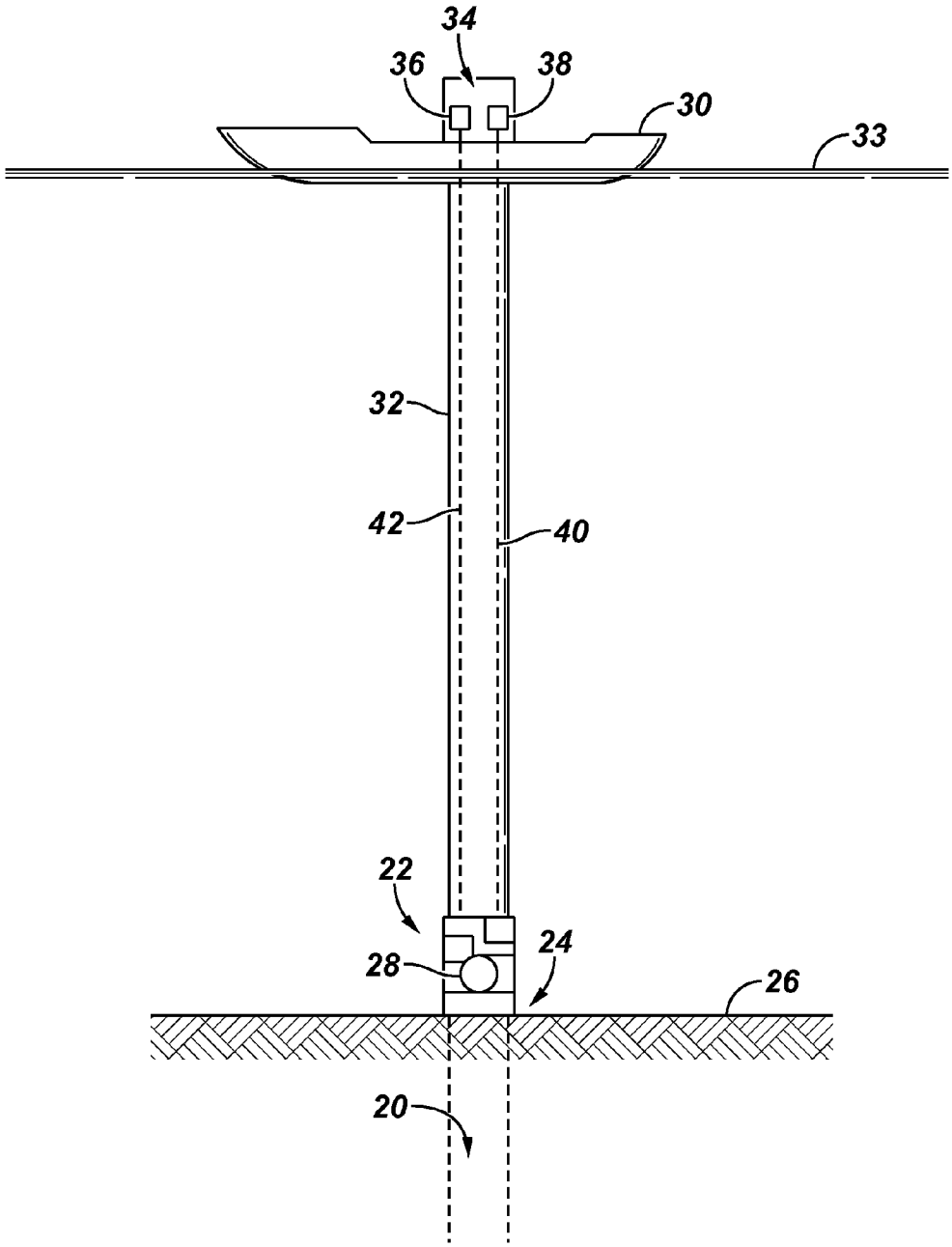
FIG. 1 is a schematic view of a well system used in a subsea application, according to an embodiment.

According to one embodiment, a subsea well 20 extends below a subsea test tree 22 positioned at a subsea location 24 along, for example, a seabed 26, as illustrated in FIG. 1. The subsea test tree 22 comprises a valve system 28 that may be selectively operated to open and shut off the subsea well 20. In the example illustrated, subsea test tree 22 is connected with a surface structure 30 via a riser 32 or other suitable structure that provides a passage through the sea between surface structure 30 and subsea test tree 22. The surface structure 30 may be at a surface location 33 and may be in the form of a surface vessel, a permanent structure or a semi-permanent structure depending on the type and location of subsea well 20.

In the embodiment illustrated, a control and monitoring system 34 is employed in cooperation with the subsea test tree 22. In this example, system 34 comprises a control system 36 operatively coupled with the subsea test tree 22 to control features of the subsea test tree, such as valve system 28. System 34 further comprises a monitoring system 38 which is positioned and employed to monitor functions of control system 36. In this example, monitoring system 38 comprises a riser instrumentation module system which is independent from and remains isolated from control system 36.

Control system 36 may be constructed in a variety of configurations with various components depending on the specific application. However, one specific example of a type of control system for controlling subsurface test trees is a subsea test tree control system available from Schlumberger Corporation and known as SenTURIAN. As noted previously, however, this type of control system employs limited or no monitoring to ensure sufficient simplicity for certification as a Safety Integrity Level (SIL) unit having a desired SIL rating, e.g. a SIL 2 rating. The SenTURIAN control system and similar systems may be defined as Safety Instrumented Systems (SAS) per IEC Standard 61508. In the present system, however, addition of the independent riser instrumentation module system 38 enables the overall system 34 to monitor functions of the primary control system 36 while maintaining isolation from the SIL system, i.e. control system 36. This allows the control system to be designed in a manner that maintains the desired SIL certification and promotes compliance with the applicable International Organization for Standardization (ISO) standards.

To maintain the desired SIL rating on control system 36 while adding monitoring capabilities, the control functions are isolated from the monitoring functions. To accomplish the isolation, the riser instrumentation module system 38 contains separate components, such as separate acquisition circuits, modem, communication lines, e.g. cable, and/or other independent components.

As discussed in greater detail below, monitoring system information may be communicated between the subsea location 24 and the surface structure 30 via a separate communication line 40, e.g. cable, relative to a communication line 42 of control system 36. By way of example, communication line 42 may comprise a plurality of hydraulic lines used to deliver fluid for actuating valve system 28 and/or other systems of subsea test tree 22. Creation of independent monitoring and control systems means that any problem with the monitoring system 38 causes no effect on the ability of control system 36 to effectively carry out its safety functions with respect to actuation of valve system 28 and/or other systems of subsea test tree 22.

Figure 2:
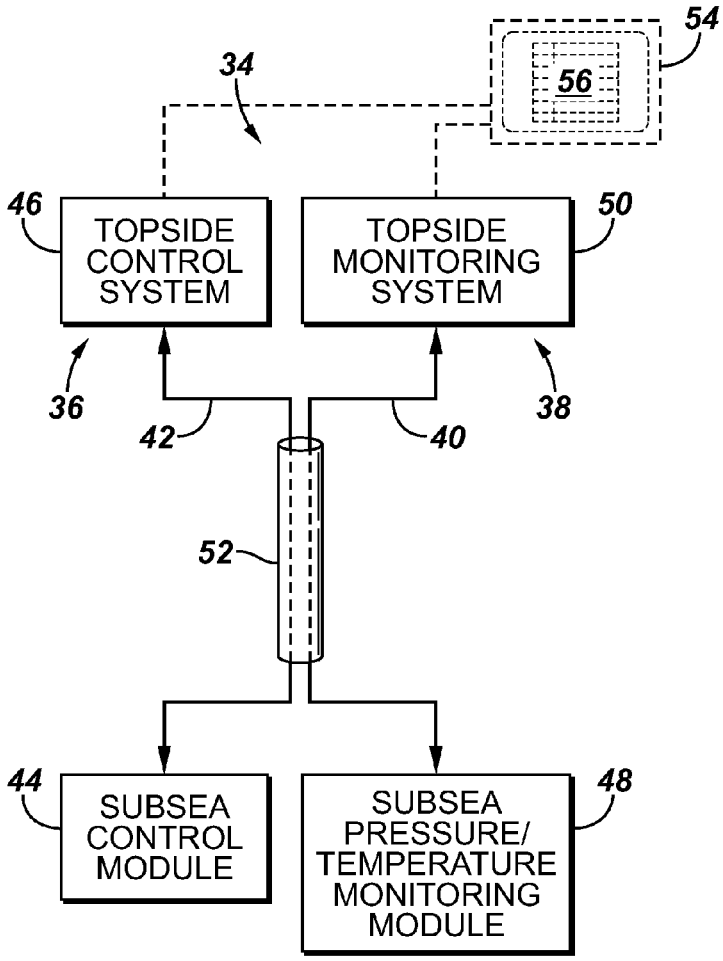
FIG. 2 is a schematic illustration of one example of a control system and an independent monitoring system positioned to monitor functions of the control system, according to an embodiment.

Referring generally to FIG. 2, the relationship between control system 36 and riser instrumentation module system 38 is illustrated. In this embodiment, control system 36 comprises a subsea control module 44 and a topside control system 46 that are connected with each other via communication line 42. By way of example, communication line 42 may comprise a multicore cable having one or more hydraulic control lines. In this example, the monitoring system 38 comprises a subsea monitoring module 48 and a topside monitoring system 50 that are connected with each other via communication line 40. By way of example, communication line 40 may comprise one or more electric, fiber-optic, wireless, or other suitable signal communication lines able to convey signals between the subsea location 24 and the surface location 33. The subsea monitoring module 48 is designed to measure and monitor desired parameters, such as temperature and pressure in hydraulic control lines used to manipulate valve system 28 and/or other systems of subsea test tree 22.

Communication line 40 and monitoring communication line 42 may be routed as two completely separated cables, or the communication lines 40, 42 may be combined in a common umbilical 52. If a common umbilical 52 is utilized, the communication lines 40, 42, e.g. cables, are maintained as independent paths for communicating signals between the subsea and surface locations. Accordingly, the isolated communication layout of the overall system is maintained. Additionally, data can be observed and/or input to control system 36 and/or monitoring system 38 via a display system 54. By way of example, display system 54 may utilize a graphical user interface 56 for displaying information to a user and for allowing the user to input control commands or other system data.

Figure 3:
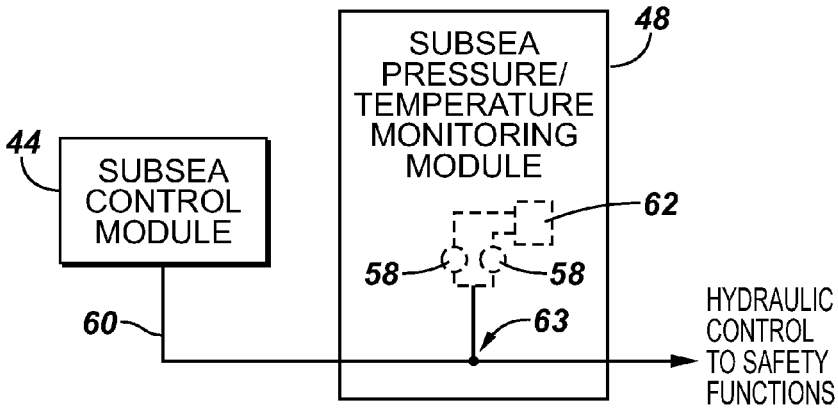
FIG. 3 is a schematic illustration of subsea components of the control system and the monitoring system illustrated in FIG. 2, according to an embodiment.

As illustrated in FIG. 3, parameters of control system 36 are monitored with appropriate sensors 58 of subsea monitoring module 48. The sensors 58 may comprise, for example, a temperature sensor and/or pressure sensor associated with individual hydraulic lines 60 extending between subsea control module 44 and controlled components of subsea test tree 22, e.g. valve system 28. In some applications, other sensors, e.g. vibration sensors, also may be employed to detect parameters related to operation of control system 36.

The sensors 58 may be associated with individual hydraulic lines or with a plurality of hydraulic lines, and the output from sensors 58 is directed to acquisition circuitry 62 that is completely independent of componentry of control system 36. Acquisition circuitry 62 may be part of subsea monitoring module 48 or may be positioned at other suitable locations in monitoring system 38. In the particular example illustrated, parameter data is directed to one or more sensors 58 by providing a "T" in the corresponding hydraulic line 60 to measure, for example, pressure and temperature of the hydraulic control line 60 without obstructing its function. Use of the "T" coupling enables observation of the desired parameter at a specific location 63 along the hydraulic line; however other systems may be used to observe the desired parameter.

Subsea monitoring module 48 may be constructed in various configurations with components selected to enable independent monitoring of control system functions. In one example illustrated in FIG. 4, the subsea monitoring module comprises a modular monitoring hub 64 that may be mounted at a variety of locations along the subsea test tree 22 and riser 32 to monitor a desired parameter or parameters related to control system 36. For example, the modular monitoring hub 64 may be constructed as a pressure and/or temperature monitoring hub utilized in cooperation with the control system 36 to monitor pressure/temperature in control lines at the desired location. The modular monitoring hub 64 may be mounted on a mandrel 66, such as a 10 ksi or 15 ksi mandrel of the type used in a variety of offshore, well related applications.

Figure 4:
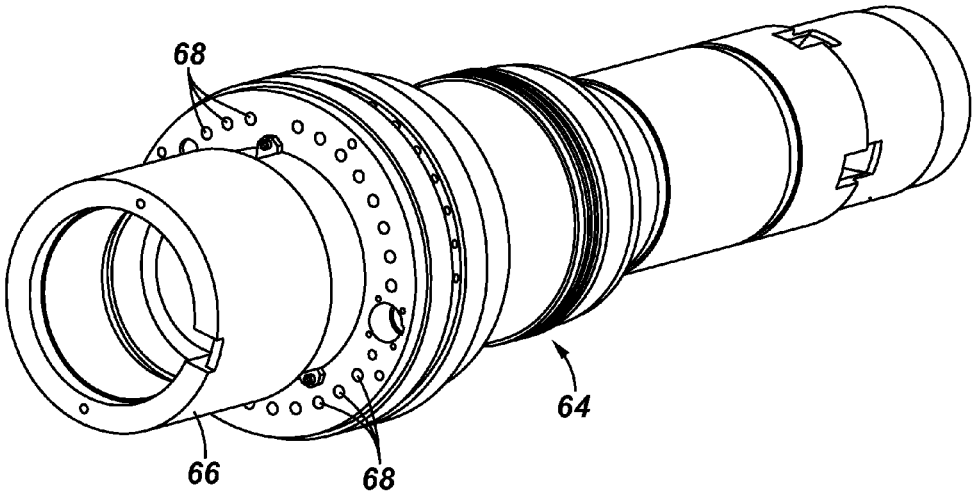
FIG. 4 is an orthogonal view of one example of a riser instrumentation module that can be utilized in the monitoring system, according to an embodiment.
Figure 5:
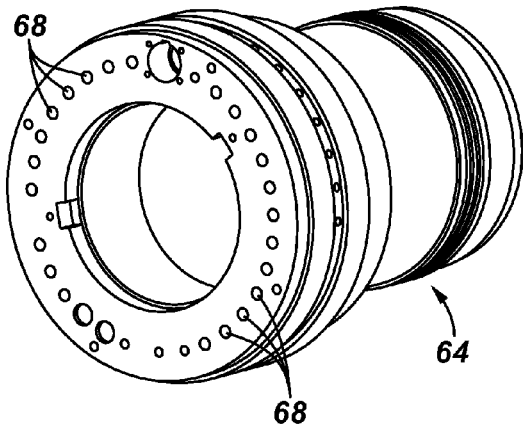
FIG. 5 is another view of the riser instrumentation module illustrated in FIG. 4, according to an embodiment.

In one example, modular monitoring hub 64 is designed to slide over and attach to mandrel 66, as illustrated in FIG. 4. As further illustrated in FIG. 5, the modular monitoring hub 64 may comprise a plurality of hydraulic flow ports 68 designed to enable measuring and monitoring of the desired parameter at specific locations 63 along subsea test tree 22 and/or riser 32. In this manner, monitoring hub 64 can be designed as a modular component for utilization in many types of riser systems to monitor hydraulic lines or other pressure lines.

Figure 6:
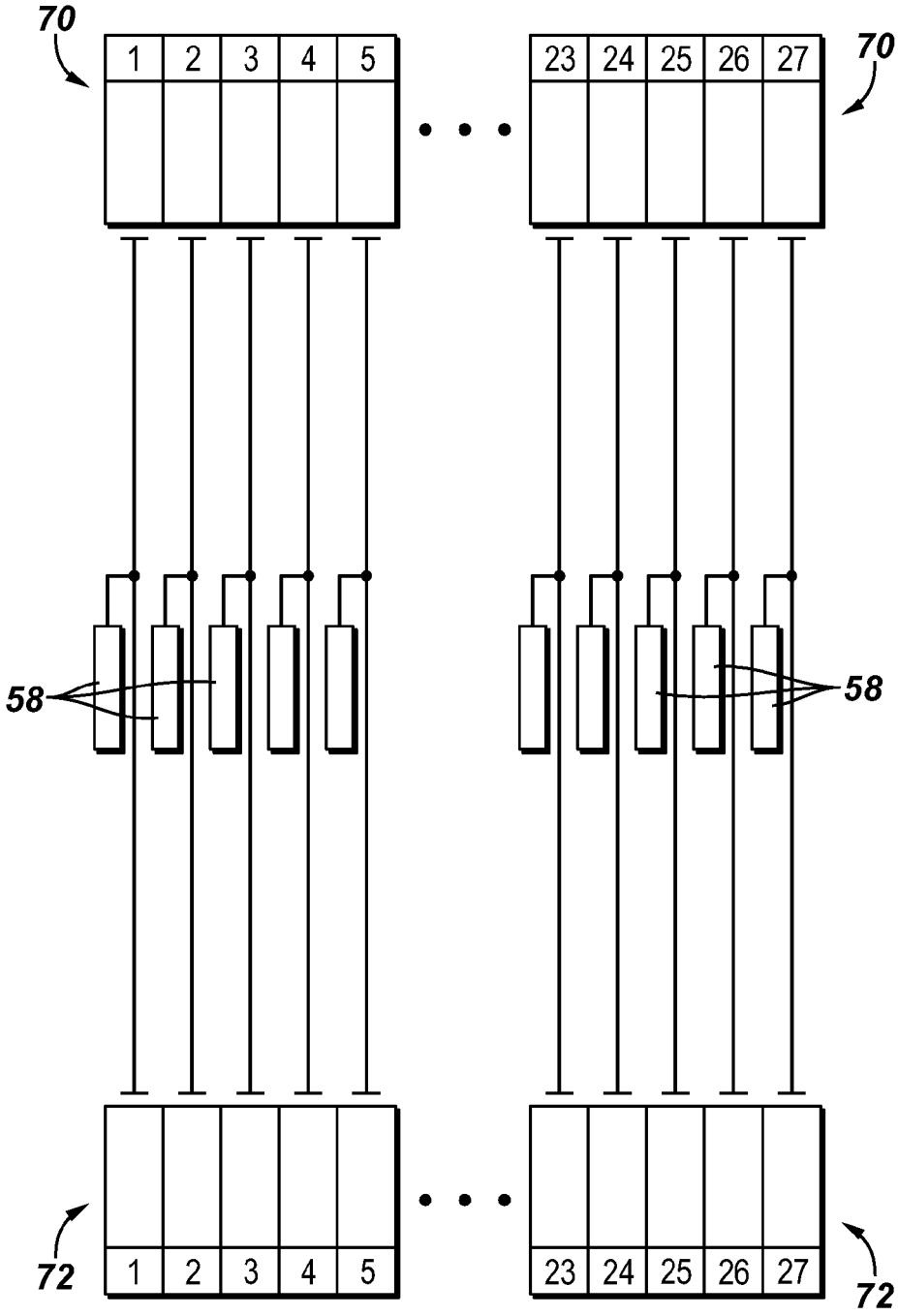
FIG. 6 is a schematic illustration of a gauge monitor pressure sensing arrangement, according to an embodiment.

The modular monitoring hub 64 may be designed with a first, e.g. top, interface 70 and a second, e.g. bottom, interface 72, as illustrated schematically in FIG. 6. The top interface 70 provides a hydraulic interface designed for connection to many types of hydraulic control lines 60 by providing appropriate adapters to form the connection. Similarly, bottom interface 72 also provides a hydraulic interface that may be connected to many types of hydraulic control lines 60 by providing the appropriate adapters. Multiple individual pressure and/or temperature sensors 58, e.g. gauges, are connected between top interface 70 and bottom interface 72 to detect parameters of the control fluid moving through individual ports 68. For example, individual sensors 58 can monitor corresponding hydraulic lines 60 at ports 68 through a "T" engagement as described above.

As a result, modular monitoring hub 64 enables the independent monitoring of multiple hydraulic control lines in control system 36. In some applications, it may only be necessary to monitor an individual hydraulic line; although monitoring hub 64 simplifies the monitoring of greater numbers of control system hydraulic lines 60.

The control and monitoring system 34 also may be designed to automatically detect the presence of riser instrumentation module system 38, e.g. subsea monitoring module 48 or specific components of the system, such as modular monitoring hub 64. For example, when monitoring hub 64 is installed in the string along riser 32 or subsea test tree 22, the system 34 automatically detects its presence and enables control of the monitoring functions conducted with respect to control system 36. In one specific embodiment, a topside system, such as topside monitoring system 50 and/or topside control system 46 may be utilized to detect the presence of modular monitoring hub 64 or other portions of riser instrumentation module system 38. Once detected, the graphical user interface 56 on display 54 may automatically be updated to include data related to monitoring system 38. In one example, the topside system accomplishes updating of the graphical user interface by monitoring a modbus port associated with the riser instrumentation module system 38. When the riser instrumentation module is detected, the topside system reads communication frames from the module to ensure the topside system sets up appropriate graphics on the graphical user interface 56.

System 34 may be constructed in a variety of configurations for use in many types of subsea wells. For example, many types of topside processing systems may be incorporated into the topside control system and topside monitoring system, respectively. Additionally, various sensors may be employed at the subsea test tree 22 or at other suitable subsea locations, and the mechanical structures used in mounting the sensors can be adjusted according to the configuration of the corresponding subsea components. Furthermore, various parameters and combinations of parameters may be measured to monitor the control system without compromising the SIL rating of the control system. This is accomplished by maintaining the monitoring system as a separate, independent system which does not utilize common sensors, common control circuitry, common communication lines, or other common components with the control system. Thus, the monitoring system is not able to interfere with operation of the control system.

The subsea test tree 22 and riser 32 also may be constructed in a variety of sizes and configurations. Depending on the specific subsea application, control system 36 may be utilized in a variety of safety controls, such as closing off the subsea well 20 at subsea test tree 22. However, control system 36 also may be designed to control other or additional functions within subsea test tree 22 and/or along riser 32.

Although only a few embodiments have been described in detail above, those of ordinary skill in the art will readily appreciate that many modifications are possible without materially departing from the teachings of this application. Accordingly, such modifications are intended to be included within the scope defined in the claims herein and subsequent related claims.

What is claimed is:

1. A system for use in a subsea well application, comprising:

a subsea test tree having a valve system;

a control system operatively coupled with the subsea test tree to control the valve system via inputs delivered through hydraulic control lines of a plurality of hydraulic control lines; and a riser instrumentation module system positioned to monitor functions of the control system, including parameters of the hydraulic control lines via downhole sensors, while remaining isolated from the control system by maintaining circuits and communication lines separated from the control system.

2. The system as recited in claim 1, wherein the subsea test tree is positioned in a subsea riser.

3. The system as recited in claim 2, wherein the riser instrumentation module system comprises a modular monitoring hub to monitor pressure in the plurality of hydraulic control lines in the subsea riser.

4. The system as recited in claim 1, wherein the control system comprises a subsea control module; a topside control system; and hydraulic control lines, of the plurality of hydraulic control lines, connecting the subsea control module and the topside control system.

5. The system as recited in claim 4, wherein the riser instrumentation module system comprises a subsea monitoring module; a topside monitoring system; and at least one independent control line separate from the hydraulic control lines of the control system.

6. The system as recited in claim 5, wherein the hydraulic control lines and the at least one independent control line are routed through a common umbilical extending to a subsea location proximate the subsea test tree.

7. The system as recited in claim 5, wherein at least one of the topside control system and the topside monitoring system automatically detects the subsea monitoring module of the riser instrumentation module system.

8. The system as recited in claim 5, wherein the subsea monitoring module monitors temperature and pressure of hydraulic lines in the control system.

9. The system as recited in claim 5, wherein the riser instrumentation module system comprises independent acquisition circuitry.

10. A method, comprising:

coupling a control system with a subsea test tree to control valving in the subsea test tree;

monitoring functions of the control system at a subsea location with a riser instrumentation module system, having a monitoring hub with a plurality of hydraulic flow ports through which hydraulic control fluid of the control system is routed, by providing sensors to monitor parameters of the hydraulic control fluid moving through the hydraulic flow ports; and isolating the riser instrumentation module system from the control system by completely separating circuits and communication lines of the riser instrumentation module system from the control system.

11. The method as recited in claim 10, wherein isolating comprises isolating the riser instrumentation module system in a manner selected to maintain a desired SIL rating for the control system.

12. The method as recited in claim 10, wherein coupling comprises utilizing a subsea control module; a topside control system; and at least one control line connecting the subsea control module and the topside control system.

13. The method as recited in claim 12, wherein monitoring comprises employing a subsea monitoring module; a topside monitoring system; and at least one independent control line separate from the at least one control line of the control system.

14. The method as recited in claim 13, further comprising routing the at least one control line and the at least one independent control line through a common umbilical.

15. The method as recited in claim 10, wherein monitoring comprises monitoring pressures in the control system.

16. The method as recited in claim 15, wherein monitoring comprises monitoring temperatures in the control system.

17. A method, comprising:

controlling a subsea test tree with a control system;

monitoring the control system with a riser instrumentation module system; and separating the riser instrumentation module system from the control system in a manner that maintains a desired SIL rating on the control system, wherein separating comprises isolating all signal communication lines and circuits of the riser instrumentation module system from the control system to maintain the desired SIL rating.

18. The method as recited in claim 17, wherein separating comprises constructing the riser instrumentation module system with a separate communication cable and separate acquisition circuitry.

19. The method as recited in claim 17, wherein monitoring comprises utilizing a modular monitoring hub to monitor pressure and temperature.

20. The method as recited in claim 19, further comprising automatically detecting the presence of the modular monitoring hub.

* * * * *